US008695824B2

(12) United States Patent
Cavenagh et al.

(10) Patent No.: US 8,695,824 B2
(45) Date of Patent: Apr. 15, 2014

(54) FLEXIBLE CONTAINER ASSEMBLY AND METHODS FOR MAKING AND USING THE SAME

(75) Inventors: Edward John Cavenagh, Winnipeg (CA); Karen Lee MacDonald, Winnipeg (CA); Alden Dale Friesen, Winnipeg (CA); Selamawit Tedesse Desta, Winnipeg (CA)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/251,018

(22) Filed: Sep. 30, 2011

(65) Prior Publication Data

US 2012/0193354 A1 Aug. 2, 2012

Related U.S. Application Data

(60) Provisional application No. 61/456,604, filed on Nov. 8, 2010.

(51) Int. Cl.

| | |
|---|---|
| ***B65D 25/00*** | (2006.01) |
| ***B65D 90/12*** | (2006.01) |
| ***B65D 30/12*** | (2006.01) |

(52) U.S. Cl.
USPC ..... 220/9.4; 220/475; 220/495.08; 383/125

(58) Field of Classification Search
USPC ..... 220/9.3, 9.4, 475, 495.08, 495.01; 383/125, 123, 124, 31
See application file for complete search history.

(56) References Cited

U.S. PATENT DOCUMENTS

| | | | | |
|---|---|---|---|---|
| 269,625 | A * | 12/1882 | Blake | 248/98 |
| 338,892 | A * | 3/1886 | Walker | 220/9.3 |
| 1,971,642 | A * | 8/1934 | Champlin | 248/97 |
| 3,222,019 | A * | 12/1965 | Weisberg | 248/97 |
| 3,633,859 | A * | 1/1972 | Vosbikian | 248/97 |
| 3,827,471 | A | 8/1974 | Gregory et al. | |
| 3,893,595 | A | 7/1975 | Khanna et al. | |
| 4,027,987 | A * | 6/1977 | Berkowitz | 403/172 |
| 4,236,559 | A * | 12/1980 | Archbold | 224/610 |
| 4,267,996 | A | 5/1981 | Turcott | |
| 4,390,051 | A | 6/1983 | Cuthbertson | |
| 4,646,357 | A * | 2/1987 | Nattrass | 383/20 |
| 5,025,925 | A | 6/1991 | Wiklund | |
| 5,069,596 | A * | 12/1991 | Mueller et al. | 414/607 |
| 5,638,853 | A * | 6/1997 | Tsai | 135/145 |
| 5,687,881 | A | 11/1997 | Rouse et al. | |
| 5,975,759 | A * | 11/1999 | Renaud | 383/22 |
| 6,450,666 | B1 * | 9/2002 | Briscoe et al. | 362/249.14 |

(Continued)

FOREIGN PATENT DOCUMENTS

| | | |
|---|---|---|
| DE | 3928054 A1 | 2/1991 |
| EP | 0030442 B1 | 7/1984 |

(Continued)

*Primary Examiner* — Anthony Stashick
*Assistant Examiner* — Don M Anderson
(74) *Attorney, Agent, or Firm* — Whyte Hirschboeck Dudek S.C.

(57) ABSTRACT

A flexible container assembly and methods for making and using such an assembly are disclosed herein. The assembly is configured to hold an amount of material, such as heavy and/or bulky material (e.g., industrial, job or work site waste material). In some embodiments, the assembly includes a support structure and a flexible container structure configured to interface with, so as to be supported at least in part by, the support structure.

12 Claims, 8 Drawing Sheets

(56) References Cited

U.S. PATENT DOCUMENTS

| | | | | |
|---|---|---|---|---|
| 6,467,955 | B1 | 10/2002 | Kim | |
| 7,140,516 | B2 * | 11/2006 | Bothor et al. | 222/185.1 |
| 7,156,555 | B2 * | 1/2007 | Richardson et al. | 383/16 |
| 7,500,786 | B2 | 3/2009 | Richardson et al. | |
| 2007/0127852 | A1 * | 6/2007 | Town et al. | 383/16 |
| 2010/0272378 | A1 | 10/2010 | Mueller | |

FOREIGN PATENT DOCUMENTS

| | | | |
|---|---|---|---|
| GB | 2403200 | A | 12/2004 |
| JP | 2001106291 | A | 4/2001 |
| JP | 2007091315 | A | 4/2007 |
| WO | 9501294 | A1 | 1/1995 |
| WO | 2006032073 | A1 | 3/2006 |
| WO | 2010148497 | A1 | 12/2010 |

* cited by examiner

FLEXIBLE CONTAINER ASSEMBLY AND METHODS FOR MAKING AND USING THE SAME

PRIORITY CLAIM

This application claims priority to U.S. provisional patent application Ser. No. 61/456,604 filed on Nov. 8, 2010, the entire content of which is incorporated by reference herein.

FIELD OF THE INVENTION

The present disclosure relates to container assemblies and methods of making and/or using such container assemblies and, more particularly, to flexible container assemblies configured to hold any of a variety of heavy and/or bulky materials in a controlled manner.

BACKGROUND

Work or job sites, such as industrial and construction work sites, create significant amounts of waste materials of multiple types, including but not limited to, concrete, cardboard, framing, wood scraps, lumber, metal, insulation, nails, screws, wires, glass, dirt, gravel, rocks, among others (i.e., "construction material"). Such materials often take a variety of forms, shapes or sizes and include several different sources, including waste from packaging, disposal of used materials, cut-offs, damage and the like. The materials are often heavy and bulky.

One known method of collection and disposal of such work site waste includes renting a large garbage bin. With this approach, costs can be substantial, with the rental amount including costs to deliver and pick up the large garbage bin, and the cost to dispose of the materials placed into the bin. Another known method includes sectioning off a portion of a work site. With regard to this approach, a section of a work site often must be fenced off, at least temporarily, and waste materials are transported to this area for holding before later loading (usually into a large garbage bin) and transporting them away from the site. One significant disadvantage associated with this approach is that it effectively results in gathering and removing waste products not once, but twice. This can be very costly and inefficient.

It is often desired that materials such as work site waste be stored and/or transported from time to time. In view of this and given the above considerations, it is desirable for containers within which work site waste materials are stored and/or transported to be robust and to prevent or minimize premature disposal or dispersion of such wastes into the outside environment. Nevertheless, problems have been encountered in the development of such containers.

Accordingly, there exists a need for a new or improved container assembly for containing construction waste materials and/or other substances, and/or a method of making and/or a method of using such a container assembly, which addresses one or more of the above-described issues.

SUMMARY

Various embodiments of the present disclosure provide a flexible container assembly configured to hold an amount of material, such as heavy and/or bulky industrial, job or work site waste material. In one embodiment, the assembly includes a support structure and a flexible container structure configured to interface with, so as to be supported at least in part by, the support structure.

In other embodiments, the present disclosure provides methods for making, assembling and/or using such a flexible container assembly, described further below. Other features and advantages of the present disclosure will be apparent from the following detailed disclosure, taken in conjunction with the accompanying sheets of drawings, wherein like numerals refer to like parts, elements, components, steps and processes.

DETAILED DESCRIPTION

Figure 1:
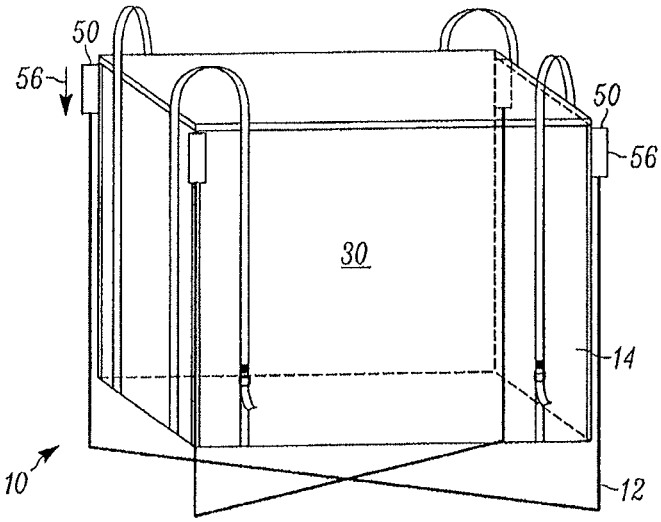
FIG. 1 is a perspective view of an exemplary embodiment of a self-supporting flexible container assembly.

Referring now to FIG. 1, an exemplary embodiment of the flexible container assembly 10 of the present disclosure (also referred to as a "container assembly") is shown. The illustrated container assembly 10 generally includes a support structure 12 and a flexible container structure 14, exemplary embodiments of which are shown. The flexible container structure 14 includes a flexible container 30, as described in greater detail below. The flexible container structure 14 and the support structure 12 are capable of or otherwise configured to interface with each other as described further below. In various embodiments, the support structure 12 supports the flexible container structure 14 in an upright fashion and, in this manner, the container assembly 10 is or can be termed "self-standing" or "self-supporting". The term "self-supporting," as used herein, is the act of maintaining the flexible container structure 14 in an upright position with the support structure 12 and without assistance from any other structure.

Figure 2:
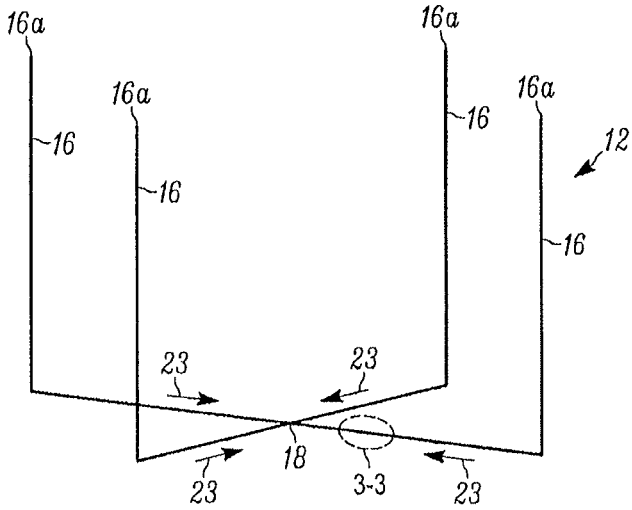
FIG. 2 is a perspective view of an exemplary embodiment of a support structure for use with the container assembly of FIG. 1.

Referring now to FIG. 2, the support structure 12 includes two U-shaped support members which include a plurality of supports and, more specifically, four (4) such vertical supports 16 are shown. Each U-shaped support member includes (also referred to as "support mechanisms") a flat bottom portion and upstanding or post-like portion extending upwardly from the respective bottom portion. In one embodiment, the vertical supports 16 are shaped/configured or otherwise formed to create an "L-shaped" configuration as shown in FIG. 2. In an embodiment, the vertical supports 16 are constructed of metal (e.g., steel). However, it should be appreciated that the vertical supports 16 may be constructed of any suitable material. The support structure 12 further includes a center piece 18. The center piece 18, as shown in FIG. 2, is a centrally-disposed device or mechanism, which is generally shaped like an "X" or a cross.

Figure 3:
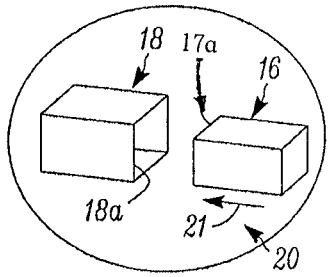
FIG. 3 is an enlarged perspective view taken along line 3-3 of FIG. 2, showing an exemplary embodiment of a connection section of the support structure.

Referring now to FIG. 3, an enlarged perspective view of an exemplary embodiment of a center piece and support connection section (also referred to as a "connection section"), generally referred to by numeral 20, of the support structure 12 is shown. At the connection section 20 and as shown, center piece 18 is about to be joined to a horizontal portion of the vertical support 16. More specifically, an end 17*a* on the horizontal portion of the vertical support 16 can be moved or slid in a direction indicated by the arrow 21 and received into an end 18*a* of the center piece 18. In the illustrated embodiment, each of the four (4) ends 17*a* of the vertical supports 16 is received by a respective one of the ends 18*a* of the center piece 18 at respective connection sections 20, as indicated by the arrows 23 shown in FIG. 2. In this manner, the overall support structure 12 is assembled. It should be appreciated that providing the connection sections 20 as described herein permits variability of container size. That is, by virtue of the sliding arrangement of the horizontal portions of the vertical supports 16 with respect to the center piece 18, the support structure can accommodate flexible container structures 14 having dimensions that can vary in at least two dimensions (e.g., a length L and a width W) as described below with reference to FIG. 10. Thus, the support structure 12 is a support structure that is configured to accommodate and support flexible container structures 14 of varying dimensions.

As illustrated in FIG. 3, ends 17*a* and 18*a* have generally rectangular cross-sections, with ends 18*a* sized larger so as to receive smaller ends 17*a*. It shall be understood that the illustrated support structure is intended to be representative and not limiting. It should be appreciated that alterative geometries, shapes and configurations are contemplated and considered within the scope of the present disclosure. It should also be appreciated that alternative manners of joining or interfacing component structures, pieces or parts, and the number of components making up a given support structure (or support), as well as the materials used to construct the structure (or component part) are contemplated and considered within the scope of the present disclosure.

Figure 3A:
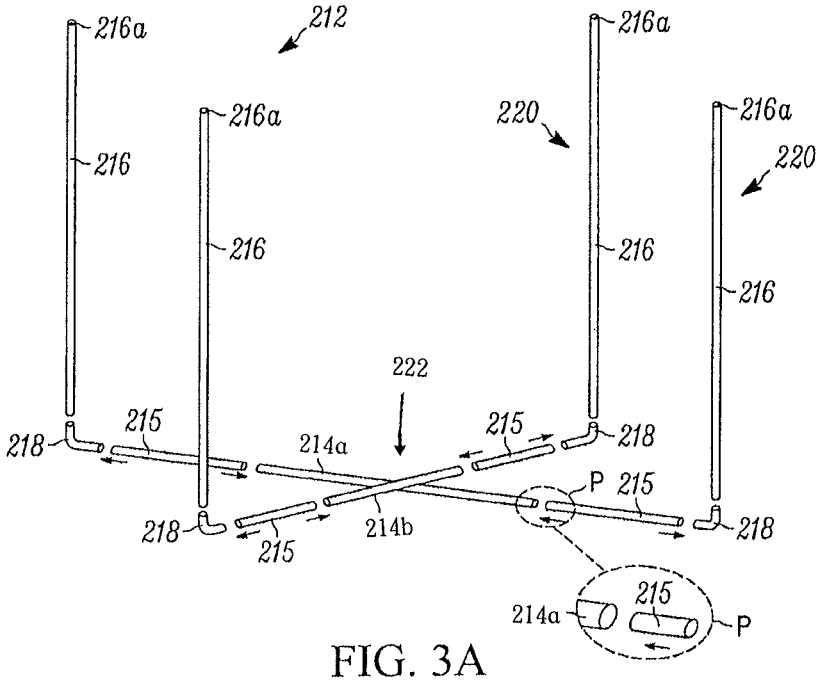
FIG. 3A is an exploded perspective view of a support structure in accordance with an embodiment of the present disclosure.
Figure 3B:
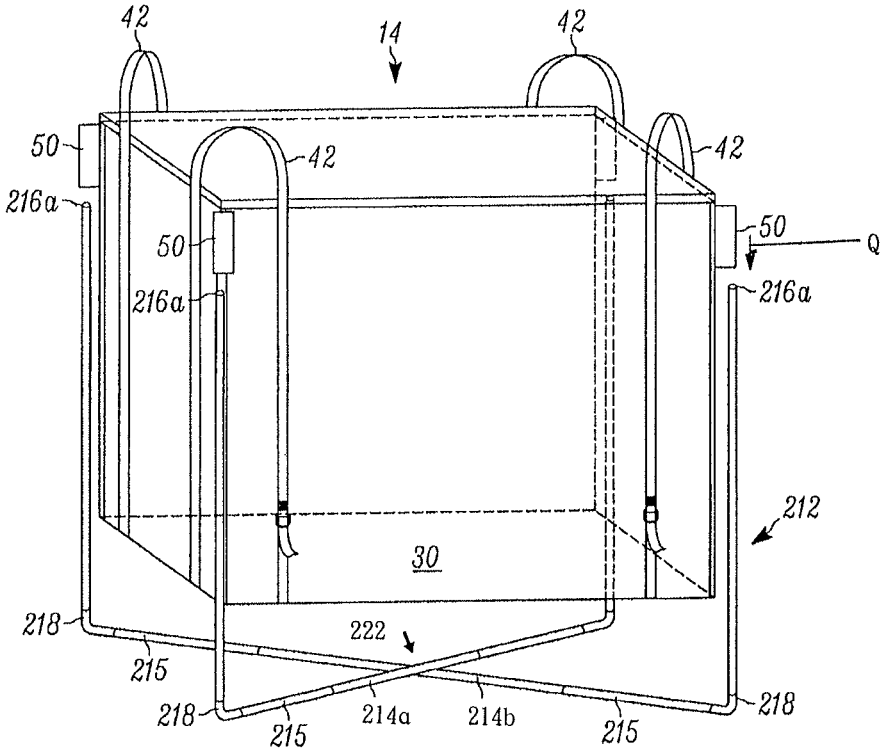
FIG. 3B is a perspective view of a flexible container assembly in accordance with an embodiment of the present disclosure.

In an embodiment, FIG. 3A and FIG. 3B show a support structure 212. Support structure 212 includes horizontal supports 214*a* and 214*b*, extension members 215, vertical supports 216, and L-shaped members 218. The L-shaped members are 90° members. Each of the horizontal supports 214*a*, 214*b*, the extension members 215, the vertical supports 216, and the L-shaped members 218 have a circular cross-section. Each of the horizontal supports 214*a*, 214*b*, the extension member 215, the vertical supports 216, and the L-shaped members 218 may be made from metal, wood, fiberglass, and any combination thereof. In an embodiment, the horizontal supports 214*a*, 214*b* and the L-shaped members 218 are made of metal, such as steel conduit. The extension members 215 and the vertical supports 216 are made from fiberglass, such as reinforced fiberglass rebar.

The horizontal supports 214*a* and 214*b* attach to each other to form centerpiece 222. Horizontal support 214*a* may be releasably attachable to horizontal support 214*b* by way of an attachment device (such as a bolt/nut, screw, and/or rivet). Alternatively, horizontal support 214*a* may be integral to horizontal support 214*b* (weld or die cast). The centerpiece 222 is X-shaped.

The extension members 215 cooperatively attach to the horizontal supports 214*a*, 214*b* and cooperatively attach to the L-shaped members 218 by way of male-female engagement, as shown in the enlarged area P of FIG. 3A. The length of the extension members 215 may be adjusted so that the support structure 212 can accommodate flexible support containers of various sizes and different sizes.

The vertical supports 216 cooperatively attach to the L-shaped members 218 by way of male-female engagement. The horizontal supports 214*a*/214*b*, the extension members 215, the vertical supports 216, and the L-shaped members form two U-shaped support members 220 with the bottom of each "U" contacting the ground or other support surface. The U-shaped supports members 220 are arranged in a crisscross manner, crossing at a common midpoint and giving the support structure 212 an X-shaped footprint on the ground as shown in FIG. 3A. The vertical supports 216 extend vertically parallel to or substantially parallel to each other. Vertical support ends 216*a* are the distal most points from the ground when the support structure 212 is assembled and deployed. The vertical support ends 216*a* are positioned to insert into the support pocket structures 50 when the flexible container 30 is moved downward to align the support pocket structures 50 on the respective vertical support ends 216*a*, as shown by down arrow Q in FIG. 3B. With the vertical support ends 216*a* inserted into the support pocket structures 50, the support structure 212 supports the flexible container structure 14 as will be further discussed below.

Figure 4:
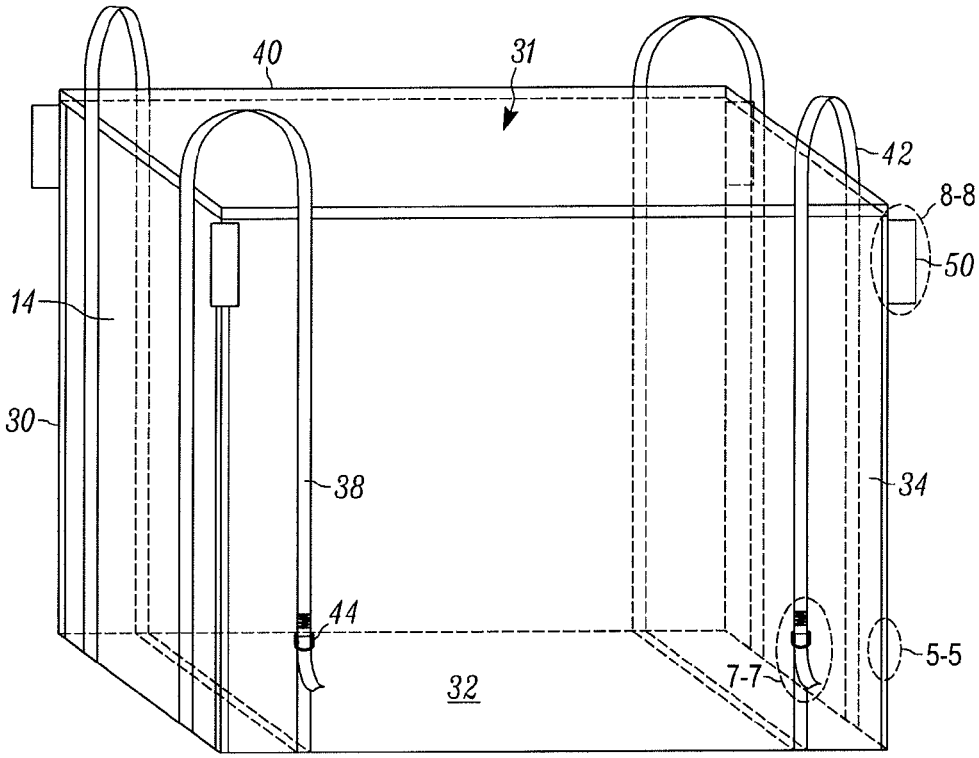
FIG. 4 is a perspective view of an exemplary embodiment of a flexible container structure including an exemplary embodiment of a flexible container for use with the container assembly of FIG. 1.

As illustrated in FIG. 4, the flexible container structure 14 includes a flexible container 30. As shown, the flexible container 30 includes a bottom wall 32 (or "bottom wall section") and four (4) side walls 34 (or "side wall sections") extending from and connected to the bottom wall 32. Thus, in the illustrated embodiment, the flexible container structure 14 takes the form of a flexible, rectangular receptacle (having a generally rectangular interior). In accordance with various embodiments, the flexible container structure 14, when assembled, can be considered a walled structure or a flexible walled structure.

In one embodiment, the flexible container 30 is constructed of a coated woven material. In a further embodiment, the coated woven material is polypropylene fibers woven together and coated. One example of a coated woven material that can be used to make the flexible container 30 is a 6 oz coated polypropylene fabric, which is commercially available. It should be appreciated, however, that any suitable material may be utilized for making the flexible container 30. Generally, materials contemplated for use in making the walls (or material layers making up the walls) of the flexible container 30 have the ability to protect (at least to some extent) against puncture or other invasive actions (such as from the robust and bulky material contemplated for storage and/or transport within the main interior of the container) that might otherwise affect the walls in a negative manner. Moreover, materials contemplated for making the flexible container 30 typically provide at least some resistance to or at least some protection against leakage of the material contents from the main interior to the exterior of the container.

Figure 5:
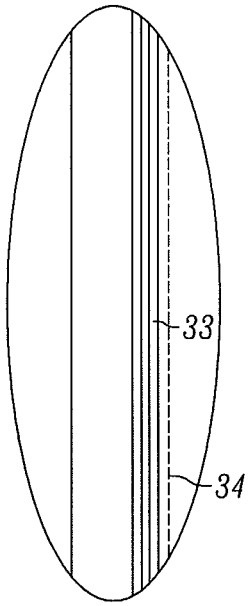
FIG. 5 is an enlarged view taken along line 5-5 of FIG. 4, illustrating an exemplary edge portion of the container structure and an exemplary manner of joining or mating the edge portion.

FIG. 5 is an enlarged view of a portion of the flexible container assembly 14 and specifically the flexible container 30 with the portion indicated by line 5-5 of FIG. 4. As illustrated in FIG. 5, edges portions or edges 33 of the side walls 34 are joined or mated. In the illustrated example, such joining is accomplished by a double needle chain stitch. However, it should be appreciated that other ways or manners of joining portions of the flexible container 30 are contemplated and considered within the scope of the present disclosure.

Figure 6:
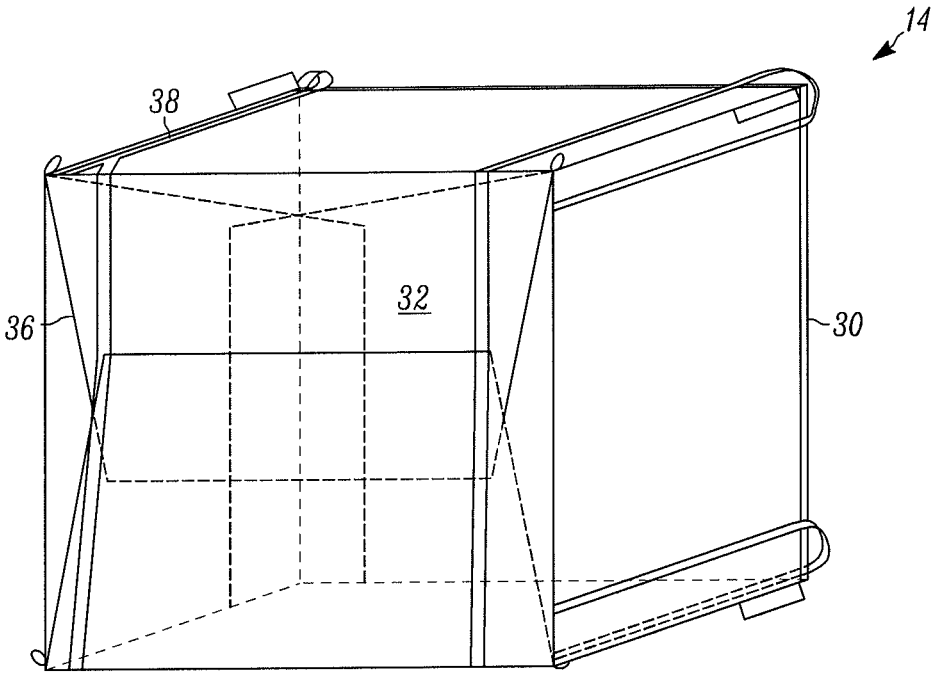
FIG. 6 is a bottom view of the exemplary flexible container structure of FIG. 4.

FIG. 6 is a bottom view of the exemplary flexible container structure 14 of FIG. 4, where the flexible container 30 is shown folded (described further below). With further reference to FIGS. 5 and 6, flexible container 30 includes a plurality of flap structures 36 (also referred to as "folded bottom flaps"), each of which extends from a respective side wall 34. The flap structures 36 are folded, one with respect to another, to create bottom wall 32. In this manner, bottom wall 32 can be termed a "folded bottom wall." The folded bottom wall is reinforced and capable of carrying or holding a substantial load or amount of material as described herein. In an embodiment, the material is a construction material. In the illustrated embodiment, each of the flap structures 36 are generally trapezoidal in shape. It should be appreciated, however, that the shape of respective side walls and bottom walls, and the shape of respective flap structures 36 extending from the side walls, can vary.

As illustrated in FIGS. 4 and 6, the flexible container 30 includes several vertically extending first straps 38. The vertically extending first straps 38 extend beyond an upper edge 40 or rim of the side walls 34 so as to form lifting loops 42 which facilitate grabbing/holding and/or transporting of the flexible container structure 14. By way of example, the flexible container structure 14 is configured, in some embodiments, to be grasped and raised by a forklift or other machine when it is being transported or moved. In some embodiments, including the example embodiment illustrated in FIG. 4, the lifting loops 42 are "cross-corner" loops that extend from one of the side walls 34 of the flexible container 30 to another of the side walls 34. The first straps 38 also assist in improving the structural strength of the flexible container 30.

Figure 7:
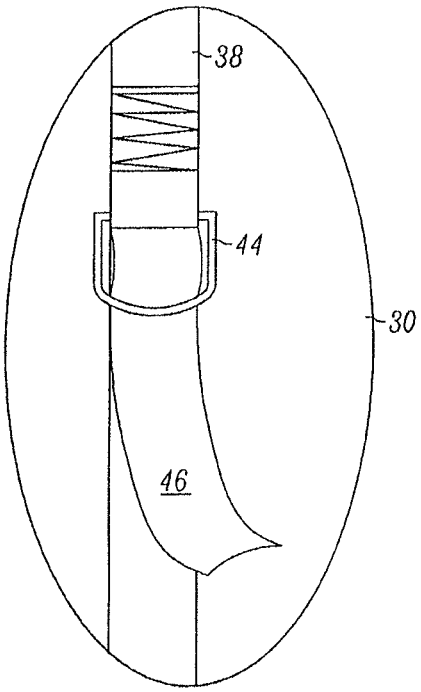
FIG. 7 is an enlarged perspective view taken along line 7-7 of FIG. 4 illustrating an exemplary embodiment of a flap closure buckle mechanism.

Referring now to FIG. 7, as well as FIG. 4, a plurality of closure buckles 44 are provided along the vertically extending first straps 38 (or "straps") proximate the bottom wall 32 of the flexible container 30. The closure buckles 44 (or "buckles"), which can take the form of D-rings or other forms, are configured to receive second straps 46 (or "bottom straps"), which are provided along the bottom wall 32. By inserting the second straps 46 through the buckles 44 and wrapping the second straps 46 back around downward through the buckles 44, the second straps 46 and the bottom wall 32 can be attached to a side wall 34 of the flexible container 30. Thus, the bottom wall 32 can be closed, thereby providing support for any material contained in an interior portion 31 within the flexible container 30 as shown in FIG. 4. The buckles 44 can be undone to release the flap structures 36 and permit the flap structures 36 to unfold and open, thereby permitting discharge of materials from the container.

In an embodiment, the flexible container structure includes lifting loops independent and separate from the first straps and the second straps. A lifting loop is permanently attached to each corner of the flexible container 30. In addition, the flexible container 30 also includes first strap 38, second strap 46 and buckle 44 as discussed above. In this embodiment, the lifting loops operate independently to support the flexible container structure during transport and/or discharge.

Figure 8:
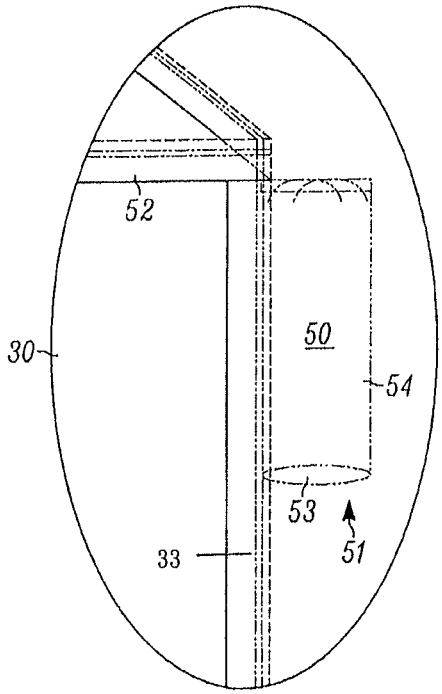
FIG. 8 is an enlarged perspective view taken along line 8-8 of FIG. 4 illustrating an exemplary embodiment of a support pocket structure.

Referring now to FIGS. 1, 4 and 8, at least one or a plurality of support pocket structures 50 (or "pockets") is connected to the flexible container 30. As shown in FIG. 1, in the illustrated example, four support pocket structures 50 are connected to the flexible container 30 of the flexible container assembly 14. FIG. 8 shows one of the support pocket structures 50 connected to flexible container 30. The support pocket structures 50 are, in some embodiments, constructed of the same material as that of the flexible container 30, although other materials are contemplated and considered within the scope of the present disclosure.

In one embodiment, the support pocket structures 50 are connected near upper ends 52 of side walls 34. In some embodiments, each of the support pocket structures 50 includes a single piece of material that is stitched together along a single seam. In one embodiment, the connection of each support pocket structure 50 to the flexible container 30 is accomplished by stitching, typically at a location other than (e.g., opposite to) the seam, the support pocket structures directly to the flexible container 30. In various embodiments, the connection is accomplished via stitching, such as double needle chain stitching, although other manners of connecting are contemplated and considered within the scope of the present disclosure. In some embodiments, the support pocket structures 50 include portions 54 that are stitched together along edges 33 (FIG. 8) to create an interior region 51 (or "interior") that is accessible via an opening 53. In some embodiments, edge connection or mating is accomplished via a single needle lock stitch, although other manners of connecting are contemplated and considered within the scope of the present disclosure.

It is further noted that the flexible container structure 14 can be positioned, for example, using the lifting loops 42 (including manually), relative to the support structure 12 such that the vertical supports 16 (216), may be received into respective interior regions 51 (FIG. 8) of the support pocket structures 50, as indicated by arrows 56 of FIG. 1. It is noted that interior regions 51 can be shaped or otherwise designed to receive vertical supports 16 (216) in an appropriate manner. In this manner, a variety of support and support pocket structure shapes and/or sizes are contemplated and considered within the scope of the present disclosure.

Set-Up/Use/Operation

Figure 10:
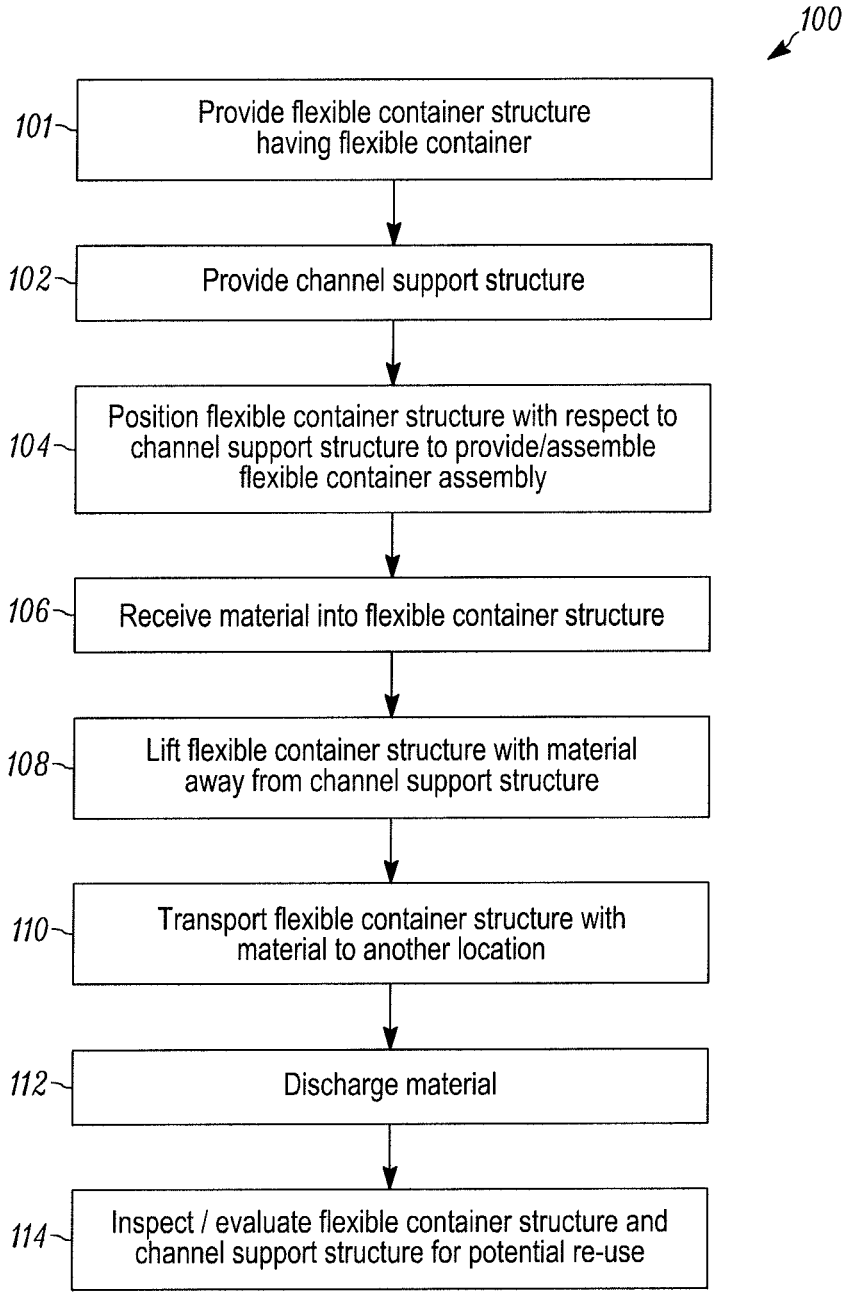
FIG. 10 is a flowchart of an example process for set-up and use of the flexible container assembly.

A flowchart of an example process 100 for set-up and use of the container assembly 10 is illustrated in FIG. 10. Although the process 100 is described with reference to the flowchart illustrated in FIG. 10, it will be appreciated that many other methods of performing the acts associated with process 100 may be used. For example, the order of many of the steps may be changed, and many of the steps described are optional.

As indicated by block 101, a flexible container structure 14 is provided, typically, along with a plurality of identical or substantially identical flexible containers and typically via a shipping or other transporting type of vessel or container (not shown). The flexible container structure is unpacked or otherwise removed from the shipping container and inspected (e.g., manually and visually) to ensure the folded bottom flap structures 36 are folded and appropriately secured using buckles 44, which secure the first straps 38 and the second straps 46. A support structure 12 is provided, as indicated by block 102. In one example embodiment, horizontal portions of the vertical supports 16 are fit into or otherwise connected to center piece 18 as described above, to at least partially assemble support structure 12. Flexible container structure 14 is positioned with respect to the support structure 12, as indicated by block 104. In some embodiments, support pocket structures 50 are positioned to receive vertical supports ends 16*a* (216*a*). For example, two diagonally-opposing (at corners) support pocket structures 50 can be stretched and fit over, so as to receive, two respective vertical support ends 16*a* (216*a*) and then the two remaining support pocket structures 50 can be stretched and fit over, so as to receive the remaining two vertical support ends 16*a* (216*a*) within an interior (e.g., a cylindrical interior having a circular opening) of each of the pocket structures. The flexible container 30 can then be extended so as to be positioned to receive materials, such as the types of materials described herein, as indicated by block 106. For example, a user can reach into the flexible container 30 and straighten its fabric so as to create expanded interior space.

The flexible container 30 can hold from 0, or greater than 0, or 10 kg, or 100 kg, or 200 kg, or 300 kg, or 400 kg, or 500 kg, to greater than 2000 kg, or 2000 kg, or 1000 kg, or 750 kg of material within the interior portion 31. The support structures of the kind contemplated for use herein typically provide at least some stability for the flexible containers of the kind contemplated for use therewith, for example, during at least certain conditions caused by wind. The support structures of the kind contemplated also facilitate flexible container loading due to the allowance for vertical and horizontal stretching of the container.

Figure 9A:
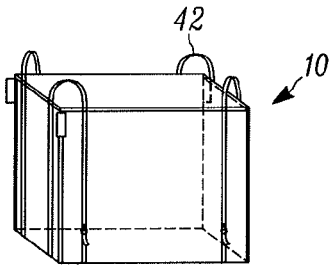
FIG. 9A-9C are illustrations showing operation of the flexible container assembly in use in accordance with exemplary embodiments of the present disclosure.
Figure 9B:
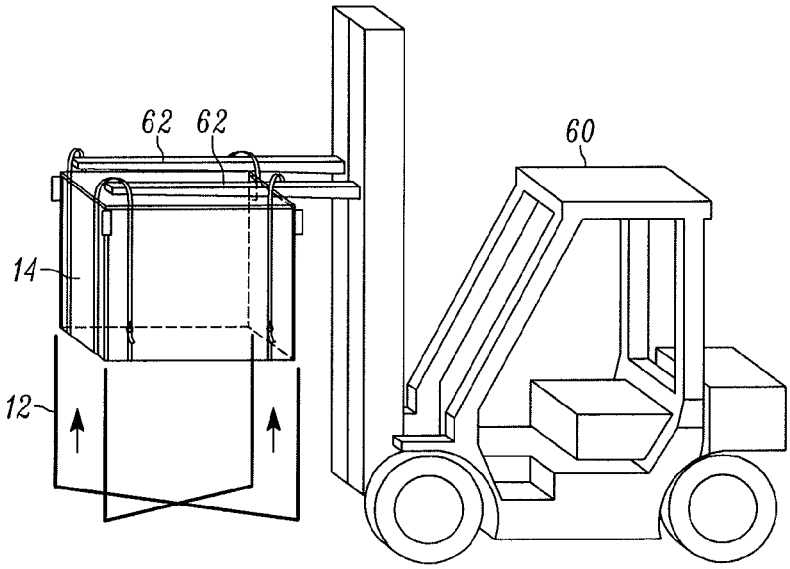
Figure 9C:
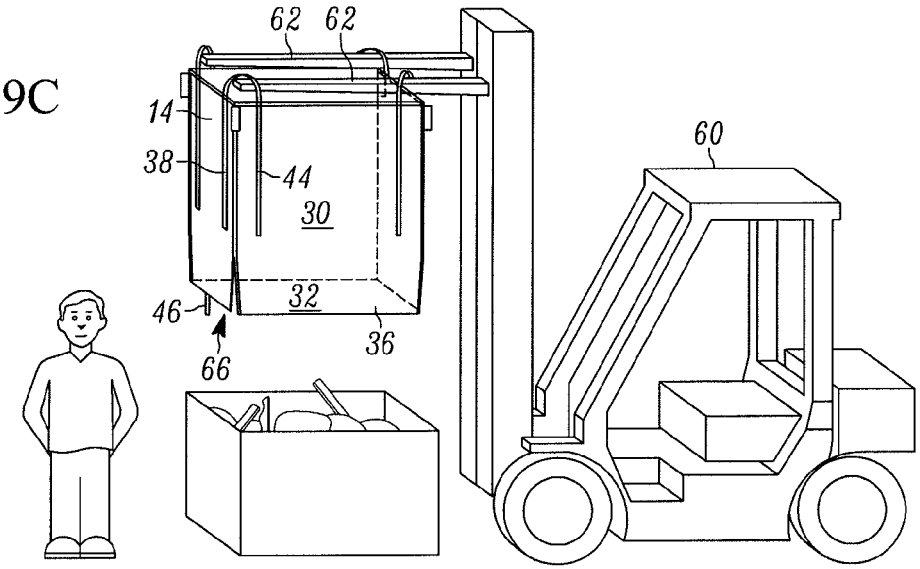

As indicated by block 108, the flexible container structure 14 is raised upwardly and away from the support structure 12. As illustrated in FIGS. 9A-9C, the lifting loops 42 are arranged or oriented in an appropriate manner (e.g., to form a generally arched or contoured form) so as to be received by a forklift 60, or other suitable industrial machine, such as a crane. In various embodiments, the forklift 60 or other industrial machine is positioned with respect to and so as to engage the lifting loops 42. For example, engagement of the forks 62 of the forklift 60 occurs by positioning the forks 62 through the lifting loops 42. Alternatively and again by way of example (not illustrated), a crane hitch of a crane (or a crane hook) is lowered so as to be positioned with respect to and to grasp the lifting loops, thereby engaging the lifting loops Using the forklift 60 or other industrial machine, the flexible container structure 14 is raised upwardly and away from the support structure 12. The raised flexible container structure 14 is transported to a dump site or to a vehicle (not shown), such as a transport or dump vehicle. By lifting the flexible container structure 14 via the lifting loops 42, the present assembly and/or method imparts little, or no, damage or disrepair to a location from which the present assembly is removed, such as, a driveway, a lawn, or other location. Moreover, the flexible container requires only enough space to accommodate the container assembly itself and accessibility for an industrial machine, for example, of the kinds noted herein. In at least this respect, the flexible container assembly of the present disclosure advantageously has a reduced overall footprint and can save space, and, as such, storage and/or placement locations of the flexible container assembly may be more varied and, among other things, include both privately and publicly owned locations.

Referring back to FIG. 10, the flexible container structure 14 is transported or hauled with the material to another location. In various embodiments, transporting or hauling of the flexible container structure 14 from one location to another (such as for disposing or discharging any materials contained therein) can take place via a larger transport bin that is towed (e.g., on or in conjunction with a trailer), or via, in some instances, in or on a truck (e.g., a truck bed) when the container is sized for such application. Other transport schemes or methods are contemplated and considered within the scope of the present disclosure. Once transported to another location (not shown), the contents or the materials contained by the flexible container structure 14 (not shown) are disposed or discharged from the flexible container structure 14, as indicated by block 112. For example, the material or contents (e.g., construction materials or other materials or contents) can be conveniently emptied or discharged from the flexible container structure 14 into a depositing region intended to receive such material (e.g., a receiving structure positioned beneath the container structure, which is also not shown).

In various embodiments of the present disclosure, discharge of contents (not shown) takes place via the bottom wall 32 (FIG. 6). That is, the buckles 44 are released to disconnect the second straps 46 from respective the first straps 38, and the flap structures 36 are unsecured or otherwise released to unfold and discharge any contents or materials making up a given load via a bottom opening 66 of flexible container 30 (FIG. 9). The positioning of the buckles, in some embodiments, permits the buckles to be undone without reaching under or below the flexible container 30. Once discharge of contents from the flexible container structure 14 has taken place, the flexible container 30 and/or flexible container structure 14 is typically inspected, as indicated by block 114, such as to determine if the flexible container structure 14 is acceptable for re-use. In various embodiments, such inspection includes an evaluation or inspection of the coated woven material of the flexible container 30, as well as the support structure 12 (including the vertical supports 16 and the center piece 18), for wear and tear, including damage to the materials making up the flexible container 30 and/or the support structures. If the flexible container structure 14 and/or the support structure 12 is re-useable, the buckles 44 are typically reattached (following folding of the respective folded bottom flaps) and the flexible container structure 14 is typically moved (e.g., using the industrial machine) and lowered once again for set-up with respect to the support structure 12, typically via the support pockets 50 described previously.

Figure 11:
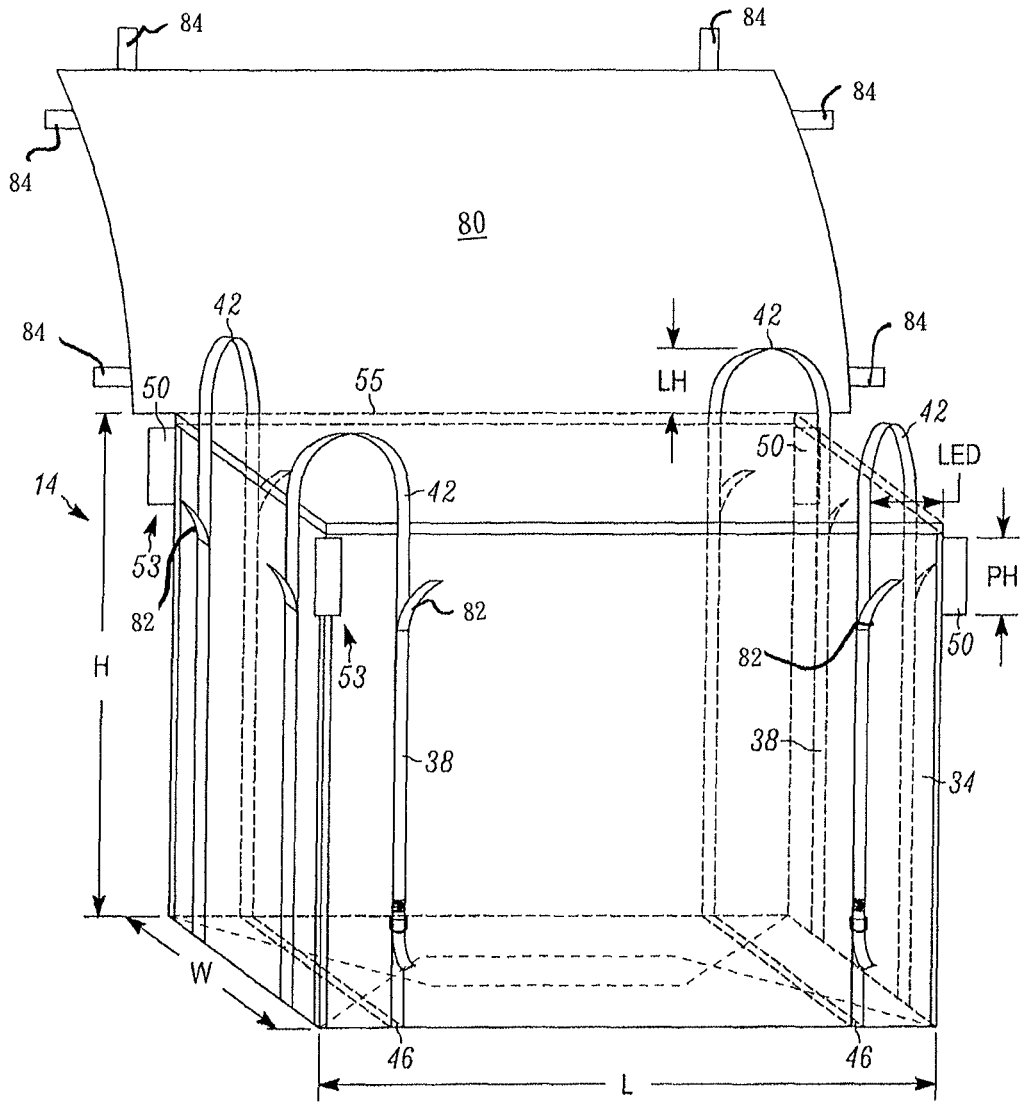
FIG. 11 shows the flexible container assembly including representative dimensions in accordance with embodiments of the present disclosure.

FIG. 11 shows an exemplary flexible container structure 14 having a flexible container 30 in accordance with embodiments of the present disclosure and including exemplary measurements or dimensions for the container structure. It should be appreciated that the measurements are provided by way of example and not limitation, and measurements are provided not in absolute terms, but rather, are indicative of measurements that can be achieved within acceptable tolerances. The illustrated flexible container 30 has a length (L) of 66", a width (W) of 66" and a height (H) of 54". Lifting loops 42 extend from first straps 38, which are positioned at a distance ("LED" for "loop edge distance") of 11" from the sidewall edges 54. Lifting loops 42 further extend, as noted above in a generally arcuate fashion, to a height ("LH" for "loop height") of 10" above an upper edge 55 of sidewalls 34. Finally, pocket structures 50 are shown having a finished height dimension of 12". Additionally, pocket structure 50 is shown to include an opening 53 having a 6" circumference. The flexible container 30 may alternatively be sized to have a length (L) of 72", a width (W) of 72" and a height (H) of 54". In alternative embodiments, the flexible container 30 may be sized to have a length (L) of 96", a width (W) of 96" and a height (H) of 54". Alternative sizes for the above are contemplated and considered within the scope of the present disclosure. It is contemplated that, in some embodiments, material contents of the flexible container 30 or the flexible container structure 14 can fit or otherwise be contained in a conventional 20 yard sized roll-off bin (22' long by 8' wide) and, in other embodiments, the contents of the flexible container 30 or the flexible container structure 14 itself can fit or otherwise be contained in a utility trailer. Moreover, as noted above, the support structure is, in some embodiments, capable of being used in conjunction with flexible container structures of varying sizes and/or dimensions. Accordingly, if a differently sized flexible container structure is desired for use, the support structure can be adjusted (e.g., at least partially disassembling and then reassembling) to accommodate the flexible container structure having one or more dimensions that are different from a previous flexible container structure used with the support structure. The process and/or actions described above can be performed with the adjusted support structure.

FIG. 11 shows an embodiment wherein the flexible container structure 14 includes a top flap 80. The top flap 80 is attached along a portion of the edge 55. In an embodiment, the top flap 80 is sewn or otherwise stitched to forming a hinge-like attachment between the top flap 80 and the flexible container 30. The top flap 80 covers the interior region 51.

In an embodiment, side straps 82 extend from the first straps 38. Tabs 84 attach to the top flap 80. The tabs 84 and are positioned on the top flap 80 so a tab 84 is configured to cooperatively interface with a respective side strap 82. Each tab 84 releasably attaches to a respective side strap 82 to secure the top flap 80 to the flexible container 30. Nonlimiting examples of releasable attachment between the side strap 82 and the tab 84 may be by way of buckle, hook and loop material, and/or knot-tying.

In various embodiments of the present disclosure, an efficient system and/or assembly is disclosed here that provides for support, collection and/or holding, and transport or movement of materials (e.g., construction site or other waste materials), including one or more of: (i) materials that are bulky, robust, and typically heavy and/or otherwise cumbersome to gather and transport; (ii) materials that are homogenous in nature; (iii) materials that are a heterogeneous mix; (iv) and a variety of other materials (e.g., at a construction site, materials may include multiple material types, such as concrete, cardboard, wood scraps, plastic, metal, insulation, etc.).

The system/assembly of the present disclosure provides for both transport (e.g., via a transport vehicle) and later disposal (e.g., at a disposal location or site) of such materials or substances. It should be appreciated that the size, shape, and configuration of the container assembly (or constituent subassemblies, structures, or components) and/or the weight support capabilities of the container assembly can vary. In various embodiments, the flexible container comprises a polypropylene receptacle or bag that is capable of lifting large or substantial loads, from greater than 0 kg to 2000 kg, or greater than 2000 kg when used by way of example in a construction application, the bag can be stored and/or folded with other construction supplies.

The flexible container assembly of the present disclosure and components for the same are mobile, particularly when empty, and often re-usable. The lifting loops 42 facilitate movement or transport of material loads when the flexible container structure is full or substantially full of material contents and the flexible container structure is dischargeable at another location, such as a location remote from the fill location, and by way of example, via a truck or trailer. The flexible container can be of a material or design and size (e.g., height) that can be used to hide or at least obstruct viewing of container contents, as well as provide for large print-receiving or printable panels or walls/wall surfaces (e.g., external) that could display logos and or other information. Generally, the flexible container assembly is designed to be capable of withstanding a variety of weather and/or environmental conditions.

The present disclosure is intended to encompass numerous embodiments that include some, but not all, of the features discussed above as being part of the container assembly 10, as well as one or more other features in addition to some or all of the features discussed above. For example, while the various embodiments (including embodiments illustrated) take a substantially box-like or rectangular appearance, in other embodiments, the overall container assembly and/or assembly components or subassemblies can take other geometric shapes. For example, the flexible container or receptacle can be cylindrical in shape. Also, and by way of example, the present disclosure is intended to encompass partially-assembled subportions of the flexible container assembly, such as the container structure and/or support structure discussed above, as well as portions of such subassemblies.

Flexible container assemblies of the kind described herein can be relatively light and, thus, relatively easy to transport, while remaining robust to a sufficient extent (e.g., making it unlikely that materials contained inside the containers will be prematurely disposed of or discharged). In some cases, the container assemblies of the kind described herein are sufficiently robust enough to continue to physically contain such materials even after the materials have been collected, transported and ultimately disposed of or dumped at a final location and, thus are in at least some instances re-usable.

Further, in some embodiments, the container will have a 5:1 Lift Ratio. It should be noted that, notwithstanding discussion regarding possible safety-related features (including, for example, features related to possible damage, puncture resistance, etc.), the inclusion of such discussion should not be understood as any representation that any embodiments of the present disclosure will be, safe or satisfy any particular safety standard. Indeed, safe operation can depend on numerous factors outside of the scope of the present disclosure including, for example, manners of installation, maintenance, training of the individuals involved, etc.

Also, notwithstanding the usage above of terms such as "upper", "lower", "top", "bottom", "side", "downward" and other terms or references (e.g., arrows) to describe relative positioning or movement of various elements of the container assembly 10 relative to one another and/or another reference point (e.g., to ground), it should be understood that the present disclosure is intended to encompass a variety of other embodiments having features that do not satisfy one or more the above relational characteristics described above.

The present disclosure is further intended to encompass methods of making and/or using container assemblies such as the container assembly 10 and other container assemblies. Also, the present disclosure is intended to encompass a variety of methods of filling, transporting, and otherwise utilizing the container assembly and other container assemblies for one or more purposes such as storing and transporting various materials, such as construction waste materials and/or other materials.

While the present invention has been described in connection with what is presently considered to be the most practical and preferred embodiments, it is to be understood that the disclosure is not limited to the disclosed embodiments, but on the contrary is intended to cover various modifications and equivalent arrangements included within the spirit and scope of the claims. It is thus to be understood that modifications and variations in the present disclosure may be made without departing from the novel aspects of this disclosure as defined in the claims, and that this application is to be limited only by the scope of the claims.

Nonlimiting examples of the present invention are provided below.

E1. A flexible container assembly configured to hold an amount of material. The assembly includes a flexible container structure comprising (i) a flexible container comprising a bottom wall section and a plurality of side wall sections, the bottom wall section and the side walls sections forming a walled enclosure for containing the amount of the material within the flexible container when the bottom wall is in a closed state; and (ii) a plurality of support pocket structures, wherein a support pocket structure is connected to an upper end of each respective side wall section; and a support structure comprising a plurality of vertical supports, an end of each vertical support received into a respective support pocket for maintaining the flexible container in an upright position.

E2. The assembly of E1 wherein the support structure comprises two U-shaped support members in a crisscross arrangement.

E3. The assembly of E2 wherein the support structure has an X-shaped footprint.

E4. The assembly of E1, wherein the walled enclosure includes an open top.

E5. The assembly of E1, wherein the flexible container comprises a coated woven material.

E6. The assembly of E5, wherein the coated woven material comprises polypropylene fibers woven together and coated.

E7. The assembly of E1, wherein the bottom wall section is formed from one or more flap structures extending from one or more of the plurality of side wall sections.

E8. The assembly of E1, comprising a first strap affixed to a side wall section and a second strap affixed to the bottom wall section, the first strap releasably connected to the second strap to permit opening of the bottom wall section.

E9. The assembly of E1, comprising a plurality of lifting loops attached to a top rim of the flexible container structure.

E10. The assembly of E1, wherein the amount of material includes an amount of construction material.

E11. A method of assembling a flexible container assembly configured to hold an amount of material. The method includes:

(a) providing a flexible container structure comprising (i) a flexible container comprising a bottom wall section and a plurality of side wall sections, the bottom wall section and the side walls sections forming a walled enclosure for containing the amount of the material within the flexible container when the bottom wall is in a closed state, and (ii) a support pocket structure connected to an upper end of each respective side wall section;

(b) providing a support structure comprising a plurality of vertical supports;

inserting an end of each vertical support, into a respective support pocket structure; and (c) maintaining, with the support structure, the flexible container in an upright position.

E12. A method of disposing an amount of material, the method comprising:

(a) providing a flexible container assembly comprising (i) a flexible container structure comprising (A) a flexible container comprising a bottom wall section and a plurality of side wall sections, (B) a plurality of support pocket structures connected to an upper end of each respective side wall section, (C) a first strap affixed to a side wall section and a second strap affixed to the bottom wall section, the first strap releasably connected to the second strap and placing the bottom wall in a closed state, the bottom wall section and the side walls sections forming a walled enclosure for containing the amount of the material within the flexible container, and (ii) a support structure comprising a plurality of vertical supports, an end of each vertical support received into a respective support pocket structure;

(b) lifting the flexible container structure away from the support structure;

(c) opening the bottom wall; and (d) discharging the amount of material from the flexible container.

E13. The method of E12 wherein the flexible container assembly comprises a plurality of lifting loops attached to a top rim of the flexible container structure, the method comprising engaging, with a machine, the lifting loops; and lifting the flexible container away from the support structure.

E14. The method of E 12 comprising releasing the first strap from the second strap and discharging the material from the flexible container.

E15. The method of E12 comprising transporting, after the lifting, the flexible container structure to another location.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

We claim:

1. A method of disposing an amount of material, the method comprising:

(a) providing a flexible container assembly comprising (i) a flexible container structure comprising (A) a flexible container comprising — an openable bottom wall comprising folded bottom flaps and four side wall sections, (B) four support pocket structures connected to an exterior upper end of each respective side wall section, (C) a first strap affixed to a side wall section and a second strap affixed to the bottom wall section, the first strap releasably connected to the second strap and placing the bottom wall in a closed state, the bottom wall section and the side walls sections forming a walled enclosure for containing the amount of the material within the flexible container, (D) four cross-corner lifting loops attached to a top rim of the flexible container structure and (ii) a support structure comprising two U-shaped support members in a crisscross arrangement and having an X-shaped footprint, the two U-shaped support members comprising four vertical supports, an end of each vertical support received into a respective support pocket structure;

(b) lifting the flexible container structure upwardly and away from the support structure;

(c) removing the vertical support members from each respective support pocket structure;

(d) opening the bottom wall; and (e) discharging the amount of material from the flexible container.

2. The method of claim 1 comprising engaging, with a machine, the lifting loops; and lifting the flexible container away from the support structure.

3. The method of claim 1 comprising releasing the first strap from the second strap;

opening the openable bottom wall; and discharging, through the opened bottom wall, the material from the flexible container.

4. The method of claim 1 comprising transporting, after the lifting, the flexible container structure to another location.

5. The method of claim 1 comprising transporting, after the removing and before the opening, the raised flexible container structure to a dump site.

6. The method of claim 1 comprising discharging the amount of material into a truck bed.

7. The method of claim 1 wherein the containing comprises containing an amount of construction material in the flexible container structure.

8. The method of claim 1 comprising containing from 100 kg to 2000 kg of material within the flexible container.

9. The method of claim 6 comprising discharging from 100 kg to 2000 kg of material through the open bottom wall.

10. The method of claim 1 comprising closing, after the discharging, the opened bottom wall.

11. The method of claim 1 comprising folding, after the discharging, the bottom flaps to close the opened bottom wall;

reattaching the first strap to the second strap; and lowering the raised flexible container structure onto the support structure.

12. The method of claim 11 comprising inserting the end of each vertical support into a respective support pocket structure.

* * * * *